US007735548B2

(12) United States Patent
Cherewyk

(10) Patent No.: US 7,735,548 B2
(45) Date of Patent: Jun. 15, 2010

(54) BALL CATCHER FOR WELLBORE OPERATIONS

(75) Inventor: Boris (Bruce) P. Cherewyk, Calgary (CA)

(73) Assignee: Isolation Equipment Services Inc, Calgary (CA)

( * ) Notice: Subject to any disclaimer, the term of this patent is extended or adjusted under 35 U.S.C. 154(b) by 121 days.

(21) Appl. No.: 12/144,401

(22) Filed: Jun. 23, 2008

(65) Prior Publication Data

US 2008/0314584 A1 Dec. 25, 2008

Related U.S. Application Data

(60) Provisional application No. 60/945,989, filed on Jun. 25, 2007.

(51) Int. Cl.
*E21B 43/00* (2006.01)
*F16L 55/00* (2006.01)

(52) U.S. Cl. ..... 166/91.1; 166/267; 15/3.51; 15/104.062

(58) Field of Classification Search ..... 166/75.15, 166/91.1, 267; 15/3.5, 3.51, 104.062; 137/268
See application file for complete search history.

(56) References Cited

U.S. PATENT DOCUMENTS 3,707,161 A * 12/1972 Crawford ..... 137/269
4,016,621 A * 4/1977 Slegers et al. ..... 15/104.062
4,073,303 A * 2/1978 Foley, Jr. ..... 137/15.07
4,106,562 A 8/1978 Barnes et al.
4,132,243 A 1/1979 Kuus
6,059,032 A * 5/2000 Jones ..... 166/278
6,186,236 B1 2/2001 Cox
6,263,970 B1 * 7/2001 Blanchet ..... 166/357
6,907,936 B2 6/2005 Fehr
2005/0184083 A1 8/2005 Diaz et al.

* cited by examiner

*Primary Examiner*—David J. Bagnell
*Assistant Examiner*—Catherine Loikith
(74) *Attorney, Agent, or Firm*—Sean W Goodwin

(57) ABSTRACT

A ball catcher is adapted to be fluidly connected to a wellhead port to receive wellbore fluids and balls carried therewith. A diverter is fit to the catcher body and has a wellhead end positioned to intercept the fluid flow from the wellhead port so as to divert debris and balls carried therein into a ball recovery chamber. The diverter has a bore in fluid communication with the flow outlet and the wellhead end has flow passages formed therethrough to the bore for receiving the fluid flow free of debris and balls and discharging the fluid flow from the catcher body. The diverter and the ball recovery chamber can be connected to quick removal for replacement, repair or cleaning.

25 Claims, 8 Drawing Sheets

BALL CATCHER FOR WELLBORE OPERATIONS

CROSS-REFERENCE TO RELATED APPLICATION

This application is a regular application claiming priority of U.S. Provisional Patent Application Ser. No. 60/945,989 filed on Jun. 25, 2007, the entirety of which is incorporated herein by reference for all purposes.

FIELD OF THE INVENTION

This invention relates generally to apparatus and method for the retrieval of balls from a wellbore, such as drop balls, frac balls, packer balls and other balls for interacting with downhole tools in the wellbore. The balls are recovered with the fluid stream which flows from the wellbore, such as after stimulation operations. More particularly, the apparatus and method uses apparatus affixed to the wellhead for intercepting, separating or diverting the balls from the fluid flow for recovery.

BACKGROUND OF THE INVENTION

It is known to conduct fracturing or other treating procedures in a wellbore by isolating zones in the wellbore using packers and the like and subjecting the isolated zone to treatment fluids at treatment pressures. In a typical fracturing procedure, for example, the casing of the well is perforated to admit oil and/or gas from the formation into the well and fracturing fluid is then pumped into the well and through these perforations into the formation. Such treatment opens and/or enlarges draining channels in the formation, enhancing the producing ability of the well. Alternatively, the completion can be an open hole type that is completed without Casing in the producing formation area.

It is desired to stimulate multiple zones, or intervals within the same zone, using onsite stimulation fluid pumping equipment (pumpers). A packer arrangement is inserted at intervals isolating one zone from an adjacent zone. It is known to introduce a drop ball through the wellbore to engage one of the packers in order to block fluid flow therethrough. Passage through a downhole packer is thereby plugged off with this drop ball that is pumped into the wellbore during the stimulation flush. The drop ball blocks off this downhole packer, isolating the wellbore uphole of the downhole packer and consequently a second zone, above this downhole packer, can be stimulated. Once stimulated, a subsequent drop ball can be dropped to block off a subsequent packer uphole of the blocked packer for stimulation thereabove. This continues until all the desired zones are stimulated.

At surface, the wellbore is generally furnished with a frac-head unit including a multi-port block or a Y-type frac header, isolation tool or the like, which provides fluid connections for introducing stimulation fluids including sand, gels and acid treatments.

After the well operations, fluid from the well is flowed to surface through the wellhead or frachead. The fluid is urged from the well such as under formation pressures and/or the influence of a gaseous charge of $CO_2$ or $N_2$. The fluid from the well exits the wellhead from a horizontally extending fitting. To separate the balls from the fluid, it is known to use a cross fitting apparatus such as a plate extending across the flow path from the wellhead. The plate is typically a plate across the flow path having large slots or screen at the face such as an upside down "U" or fork shape for impeding balls recovered with the fluid while permitting fluid to flow therethrough the "U" shape It is known for balls, of which various sizes are employed in one well operation, to become lodged at the prior art U-shape or screen and block fluid flow. In other instances, the balls can break apart which encourages further blockages.

There is a need for a more effective apparatus for retrieving balls from a wellbore after a well operation.

SUMMARY OF THE INVENTION

Embodiments of the present invention intercept and divert balls returning with wellbore fluid into a ball recovery reservoir. A ball catcher body includes a replaceable diverter which separates balls and debris from the fluid flow.

In one aspect of the invention, apparatus is provided for retrieving oversize debris and balls carried with a fluid flow from a wellhead port. A catcher body is adapted to be fluidly connected to the wellhead port and has a flow outlet. A diverter is fit to the catcher body and has a wellhead end positioned to intercept the fluid flow from the wellhead port so as to divert debris and balls carried therein into a ball recovery chamber. The diverter has a wellhead end has flow passages formed therethrough for receiving the fluid flow free of debris and balls. The diverter has a bore in fluid communication with the flow outlet. Fluid flow through the flow passages enters the bore for discharge from the catcher body.

In another aspect of the invention, the catcher body is connected and positioned along a fluid flow path from the wellhead. The catcher body has a first flow path contiguous with fluid flow from the wellhead and an intersecting stagnant ball recovery reservoir. The catcher body has a catcher flow outlet for fluid free of debris and balls. The debris and balls have a first velocity vector along the flow path towards the catcher flow outlet. A diverter, fit to the catcher body and having a wellhead end extending into the flow path intercepts the fluid flow. The diverter has a bore being open at a tail end and in fluid communication with the catcher flow outlet. The diverter has a diverter face at the wellhead end and being positioned inline with the first velocity vector for intercepting and substantially arresting the debris and balls and for diverting the debris and balls along into the ball recovery reservoir. An annular chamber formed in the discharge outlet about the wellhead end of the diverter receives the fluid flow. A plurality of flow passages extending through the wellhead end of the diverter conduct fluid flow, free of debris and balls, from the annular chamber to the bore for discharge through the tail end.

As a result, a reliable and easy to clean ball catcher is provided for servicing wells after stimulation and cleaning operations such as after drilling removal of bridge plugs and the like.

DETAILED DESCRIPTION OF THE PREFERRED EMBODIMENTS

Figure 1:
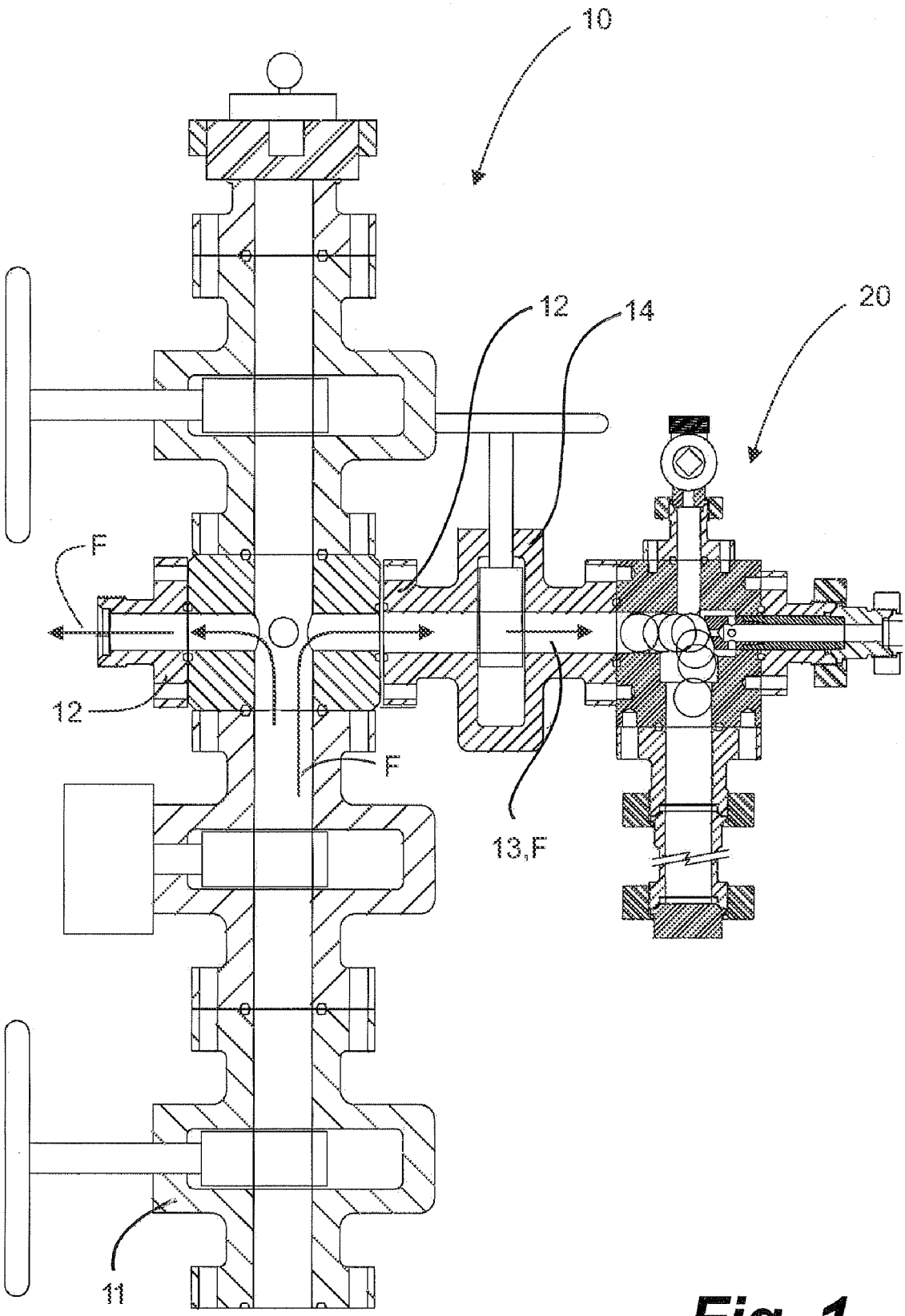
FIG. 1 is a cross-sectional view of a wellhead of conventional configuration fit with a flow port such as a frachead and a ball catcher according to one embodiment of the invention.

With reference to FIG. 1, in the context of fracturing a formation traversed by a wellbore and recovering fluid therefrom, a wellhead 10 is connected to the wellbore (not shown) for introducing fracturing fluid and drop balls for various operations to the wellbore. The wellhead comprises a shutoff valve 11 and a flow port 12 thereabove, typically integrated with a frachead. Thereafter a fluid flow F carrying debris and drop balls B are flowed out of the well through the flow port along a fluid path 13. While a variety of materials such as frac sand are carried out of the wellbore with the fluid flow, for the purposes of simplicity herein, this application discusses the apparatus and operations in the context of the recovery of balls.

Figure 2:
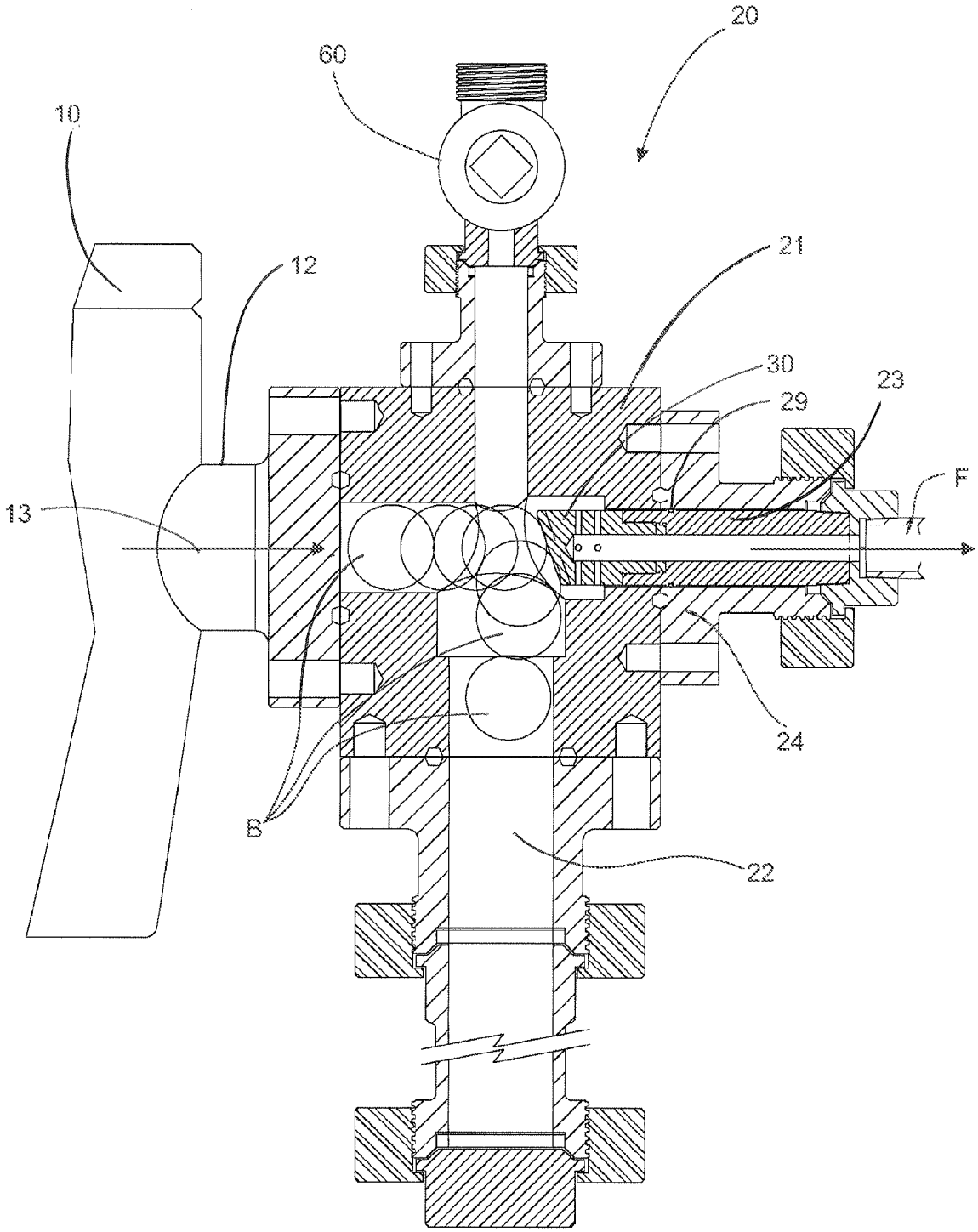
FIG. 2 is a cross section of a ball catcher body according to one embodiment of the invention fit to a flow port of a wellhead illustrating the sequential movement of a ball carried out of a wellbore with fluid flow to divert for recovery in the ball recovery reservoir.

With reference to FIG. 2, an embodiment of a ball catcher 20 is adapted to be connected to the wellhead's flow port 12, such as through an isolation valve 14, for catching drop balls B before they travel downstream and adversely affect other equipment.

As shown, the ball catcher 20 comprises a catcher body 21 fit to the wellhead 10 or isolation valve 14 at a wellhead connection using industry approved threaded or flanged connections. The catcher body 21 further comprises a stagnant reservoir or ball recovery chamber 22 which intersects the fluid path 13. Fluid flow F flows along a first velocity vector or fluid path 13 and is interrupted with a diverter 23 fit to a catcher flow outlet 24. The fluid flow F carries the balls to impact the diverter, separating fluid flow F and the balls B for discharge of the fluid flow from the catcher flow outlet 24 and recovery of the balls at the ball recovery chamber 22.

Figure 3A:
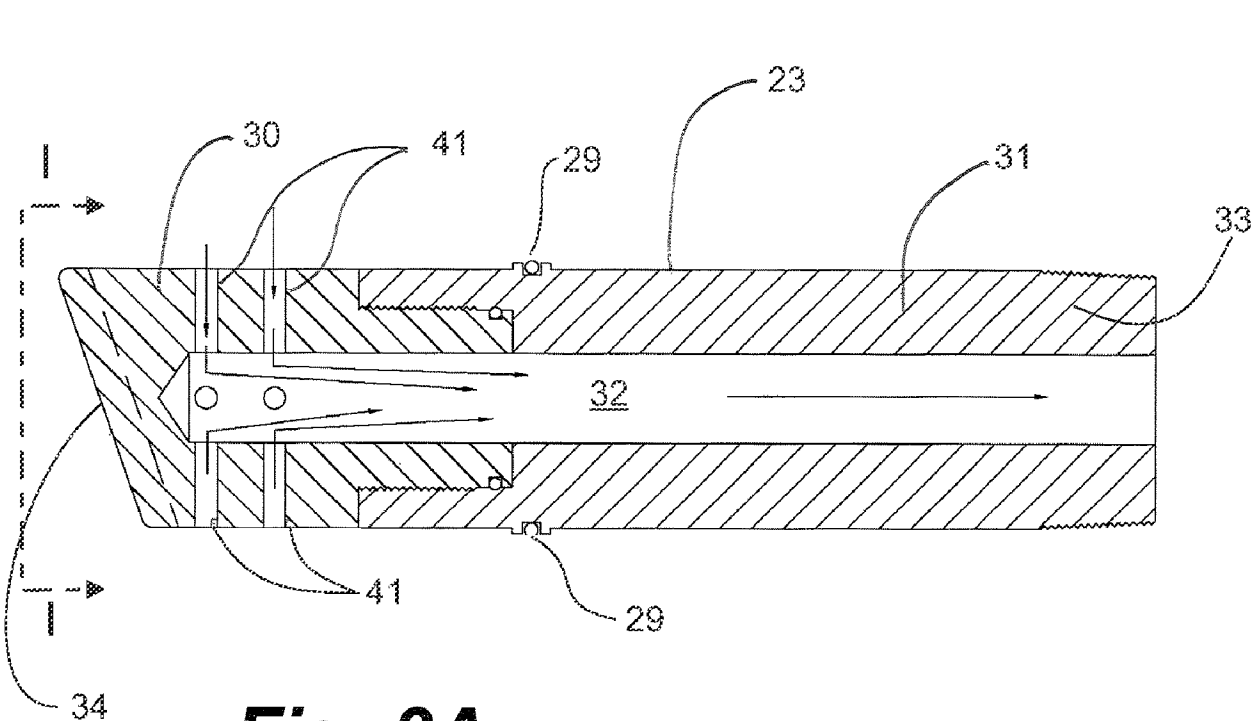
FIG. 3A is a side cross-sectional view of an embodiment of a ball diverter.
Figure 3B:
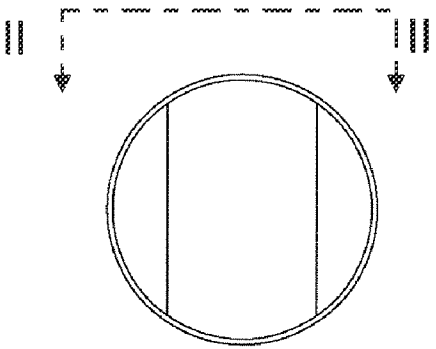
FIGS. 3B and 3C are face and partial top views of the diverter of FIG. 3A along the lines I-I and II-II respectively.
Figure 3C:
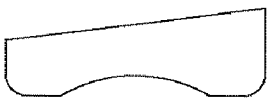

With reference also to FIGS. 3A-3C, the diverter 23 has a wellhead end 30 for intercepting the fluid flow F and a diverter body 31 fluidly sealed, such as by an O-ring 29, to the catcher flow outlet 24. The diverter body 31 has bore 32 and a fluid discharge or tail end 33. The bore 32 is open at the tail end 33 and in fluid communication with the catcher flow outlet 24 for the collection and discharge of fluid flow F liberated of oversize solids such as the balls B. The wellhead end 30 of the diverter 23 projects into the fluid path 13 and comprises a diverter face 34 positioned in the fluid path 13. The diverter face 34 is positioned inline with the first velocity vector for intercepting and substantially arresting the debris and balls B and for diverting the debris and balls along into the ball recovery chamber 22.

Referring also to FIG. 2, kinetic energy in balls B is dissipated at the diverter face 34 and the balls fall under gravity into the ball recovery chamber 22. The ball recovery chamber 22 is intersects and fluidly contiguous with, but diverges from, the flow path 13. As shown, the flow path can be substantially horizontal from the wellhead 10 and ball recovery chamber 22 is positioned below the diverter face 34. The diverter face 34 can be angled downward, from top to bottom and away from the fluid path 13, for directing, deflecting or urging the balls downward into the ball recovery chamber 22. A cross-sectional dimension of the diverter face 34 can be substantially the diameter of that of the flow path 13. Best seen in FIG. 3, the diverter face 34 can have a concave face having an axis oriented generally downwards towards the ball recovery chamber 22.

Figure 4:
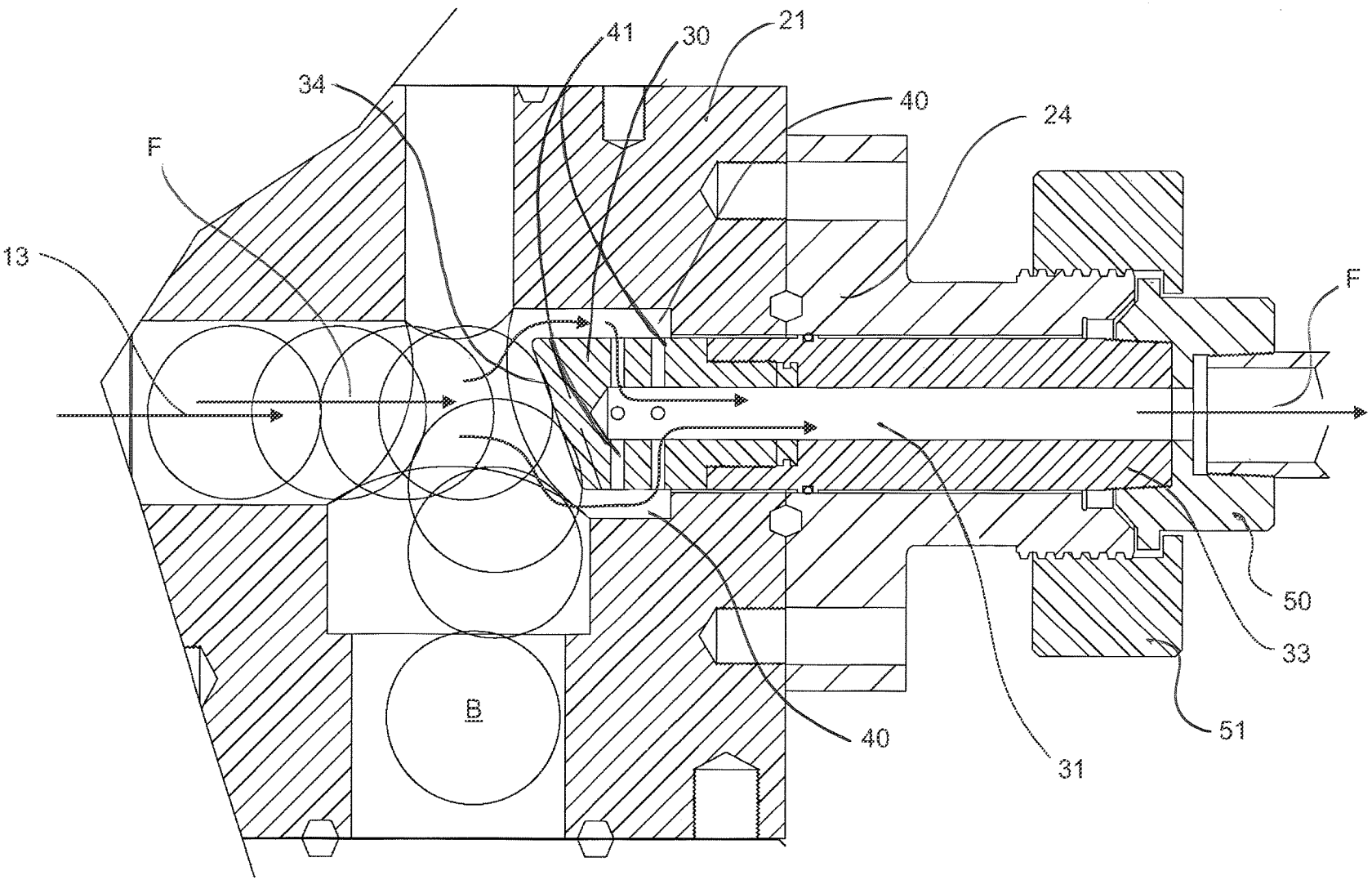
FIG. 4 is a partial cross-sectional close up view of the diverter of FIG. 4 installed in the ball catcher body.

With reference to FIG. 4, the diverter face 34 diverts oversize solids, such as debris or balls B.

In one embodiment, the diverter face 34 diverts a portion or all of the fluid flow F therearound. An annular chamber 40 is formed in the catcher body 21 or catcher flow outlet 24 about the wellhead end 30 of the diverter 23. The annular chamber 40 receives fluid flow F continuing to flow substantially along the flow path 13 and about the diverter face 34. The fluid flow F flows through the annular chamber 40 and inward through flow passages 41 formed or extending through the wellhead end 30. The bore 32 receives fluid flow F free of debris and balls for discharging the fluid flow from the catcher body.

Figure 5A:
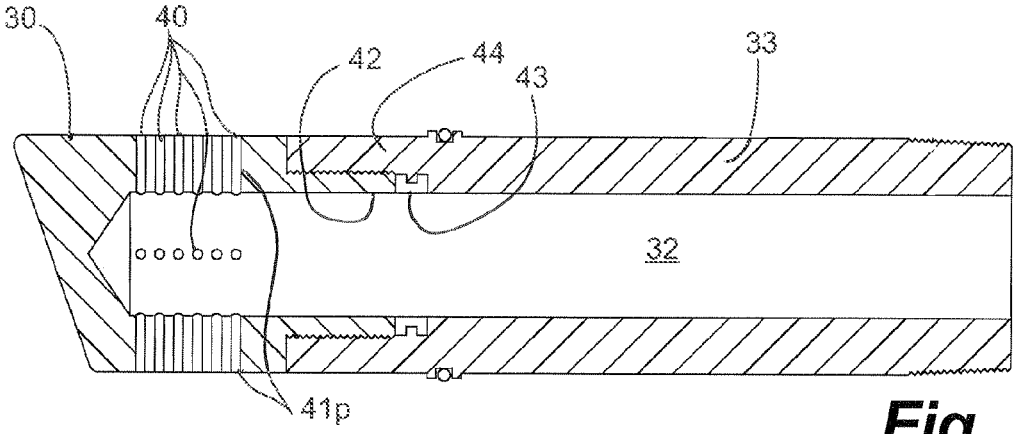
FIGS. 5A, 5B, 5C, 5D and 5E are cross-sectional views of various embodiments of a diverter.
Figure 5B:
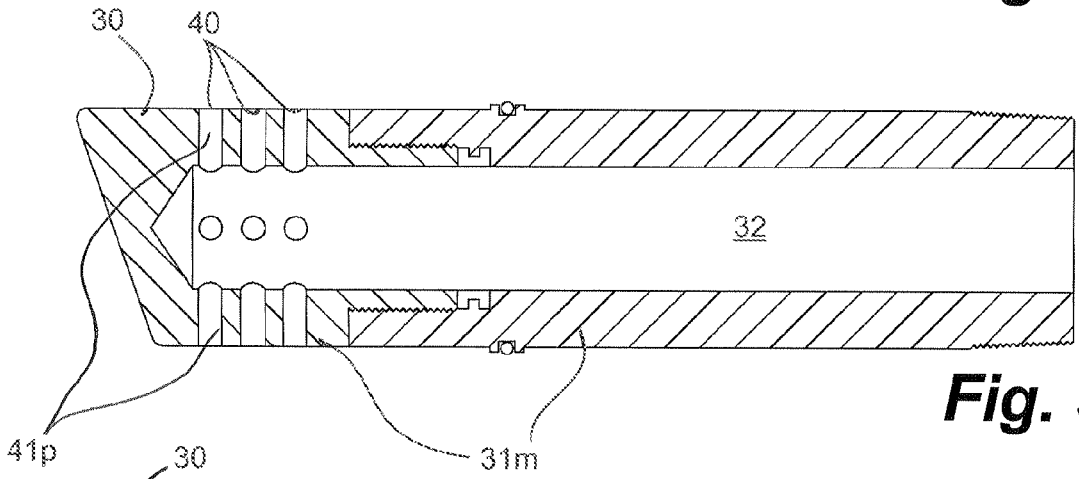
Figure 5C:
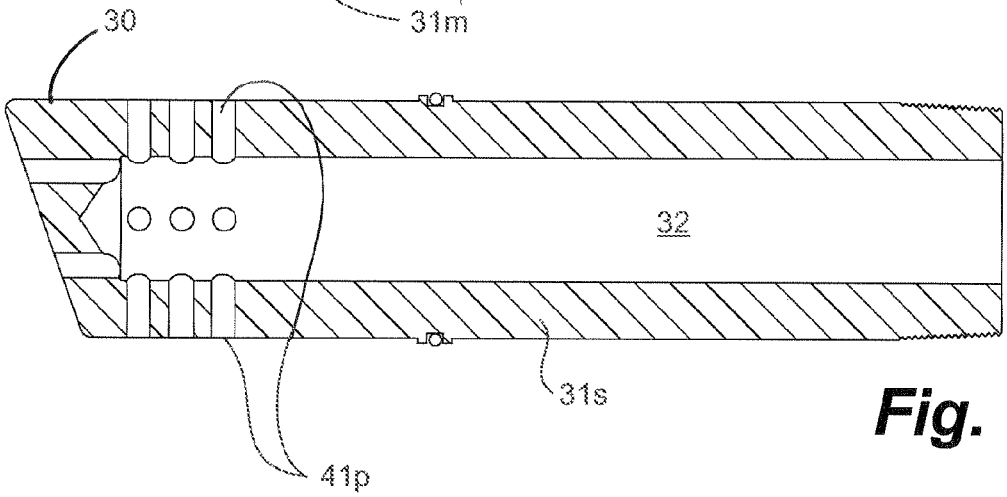

With reference to FIGS. 5A-5C, the diverter 23 can be removeably fit to the catcher body, similar to a cartridge, for ease of replacing the wear components. The diverter body 31 can be one piece 31*s*, as shown in FIG. 5C, or two or more pieces 31*m*, as shown in FIGS. 5A and 5B. A two-piece body 31*m* permits the most wear prone portion, the wellhead end 30, being separable from the tail end 33. The wellhead end 30 could be manufactured of wear resistant material. Alternatively, the flow passageways 41 are wear resistant, being coated with wear resistant material or be manufactured using replaceable, hardened orifices (not shown). The wellhead end 30 comprises the diverter face 34 and the flow passages 41 for conducting fluid flow F to the bore 32. The wellhead end 30 of a two-piece diverter body 31*m* has a threaded pin portion 42 and fluid seal 43 for sealing to a box end 44 of the tail end 33. The tail end 33 has a second fluid seal, such as the O-ring 29, for sealing to the catcher body 21.

As shown in FIG. 4, the diverter body 31 can be cylindrical for insertion into the catcher flow outlet 24 and secured or retained therein by quick connection such as a coupling 50 and hammer nut 51. The diverter can also be retained using a flanged or similar connection (not shown). The coupling 50 can be threadably engaged with the diverter's tail end 33. Replacement of the diverter can be effected by equalizing fluid pressure in the catcher body 21, releasing the hammer nut 51 and replacing the entire diverter body 31 or replacing a worn wellhead end 30 of a two-piece diverter body 31*m*.

The flow passages 41 can be radial flow passages 41 or extend substantially in-line with the flow path 13. As shown in FIGS. 5A-5C and 5E, some flow passages 41 though the wellhead end 30 can be radial, extending to the bore 32. Further, the flow passages 41 can be oriented radially and opposingly positioned to neutralize fluid energy as the fluid flow F enters the diverter bore 32. The plurality of flow passages can be arranged in pairs of opposing flow passages 41*p* for directing fluid flow F to impinge each other within the bore 32 and dissipate energy to minimize erosion.

Figure 5D:
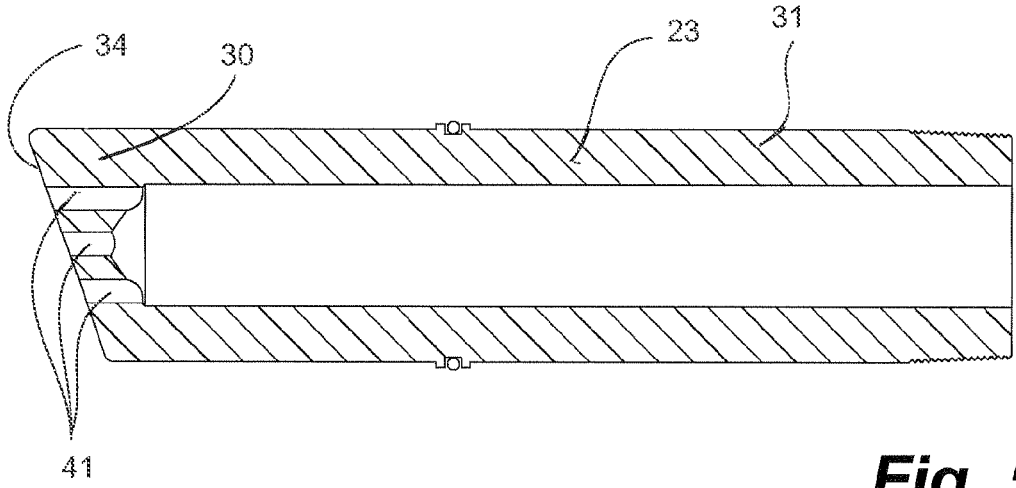
Figure 5E:
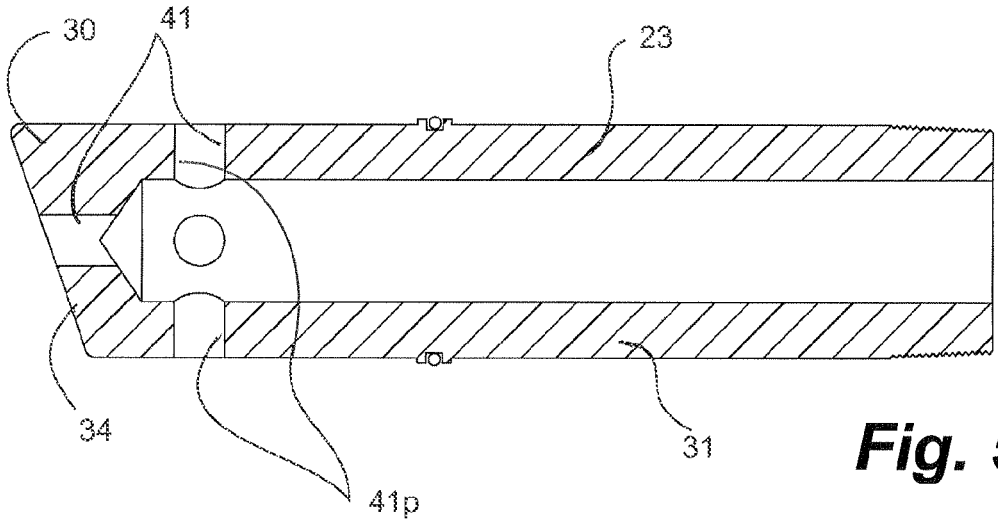

The flow passages 41 in the diverter are sized to pass the fluid flow F and can be oversized to accommodate accumulative loss due to plugging. Further, the fluid passages can be sized to be large (FIGS. 5B, 5C and 5E) for passing a range of particulates to the downstream equipment. In another embodiment, the fluid passages can be small (FIGS. 5A and 5D) for blocking the passage of large particulates for the protection of the downstream equipment, the large particulates being collected instead in the ball recovery chamber 22. A plurality of small flow passages 41, such as those shown in FIG. 5A, can act as screen to reject undesirable particulates. Similarly, a cylindrical screen could be fit over larger flow ports.

For example, with reference to the embodiment of FIG. 4, eight flow passages 41 arranged in four pairs 41*p*, positioned at quadrants, at ⅛" diameter each can pass 5-7 $m^3$ (per hour) of fluid (such as water or lighter hydrocarbons). Eight flow ports at 5⁄32" diameter can (each) pass 9-11 $m^3$/hour and ¼" ports can (each) pass 20-25 $m^3$ (per hour). The greater the number of flow passages passing the return fluid, the less the erosion, thus increasing the life and efficiency of the diverter or diverter cartridge.

Figure 6:
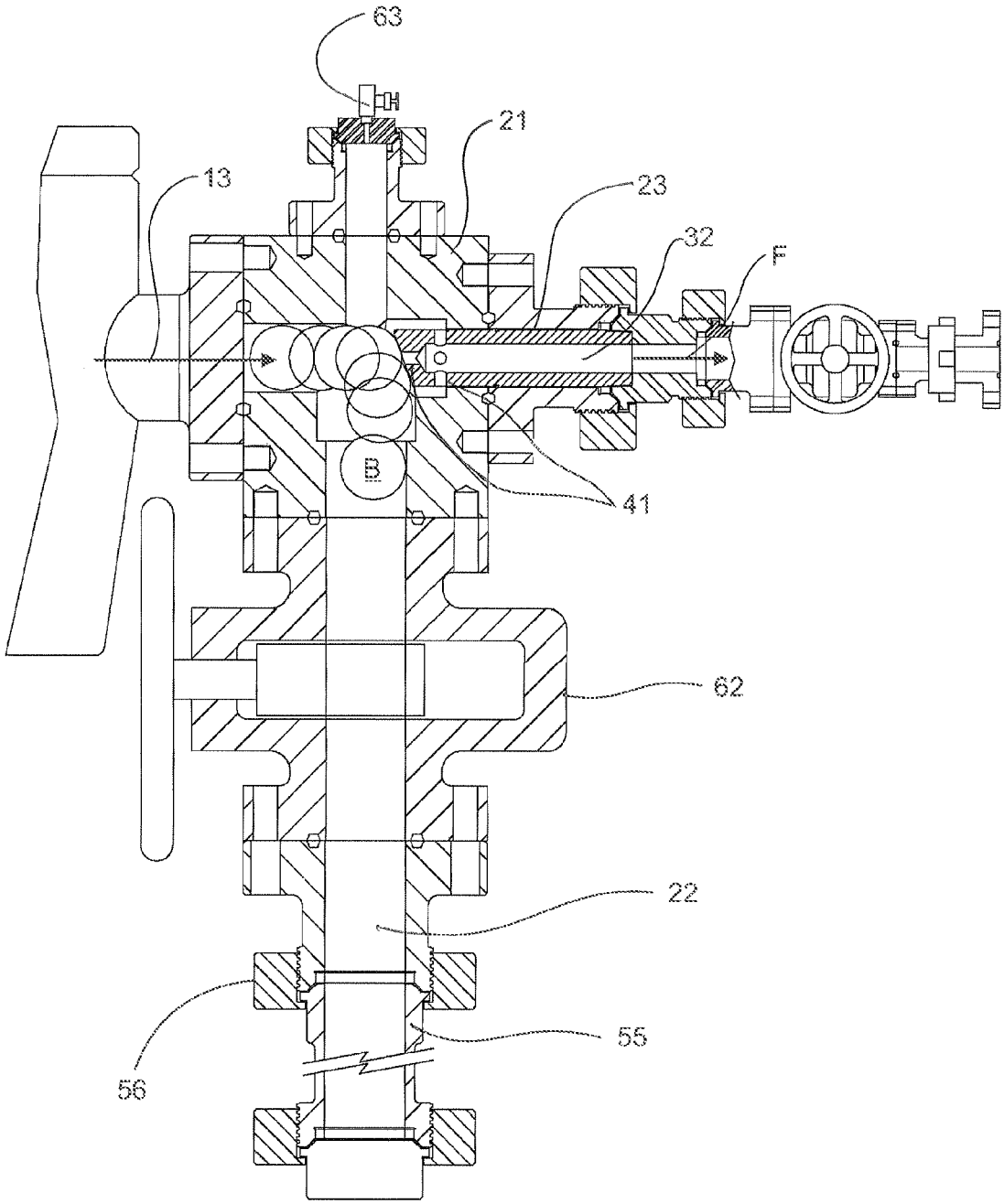
FIG. 6 is a cross-section of an alternate embodiment of a ball catcher body and illustrating a diverter accordingly to FIG. 5E.

With reference to FIG. 6, in another embodiment, the diverter 23 can further comprise in-line flow ports through the diverter face 34 and oriented into the fluid path 13. The in-line flow passages are smaller in diameter than are the solids or balls B being rejected and collected in the ball recovery chamber 22.

Operation

As shown in the embodiments shown in FIG. 2, upon establishing fluid flow F from the wellbore, balls B (and other debris) engage the diverter face 34 and are collected in the ball recovery chamber 22. Fluid flow F continues downstream, passes through the diverter's flow passages and is discharged through the diverter's tail end 33 to other equipment as is the usual practice in the industry.

Periodically, the wellhead 10 is shut in and a bleed valve 60, such as positioned atop the catcher body 21, is vented to equalize pressure therein and the ball recovery chamber 22 can be emptied of debris and balls B. The diverter 23 can be quickly inspected and replaced as necessary, therefore decreasing the down time in flow back procedures. The ball recovery reservoir can further comprise a pup joint 55 coupled releaseably to the ball recovery chamber 22 using quick connect couplings 56. In another embodiment the wellhead 10 can be isolated from a catcher body 21 and fluid from the downstream equipment can be backflowed through the diverter 23 and ball recovery chamber 22 for cleaning.

Figure 7:
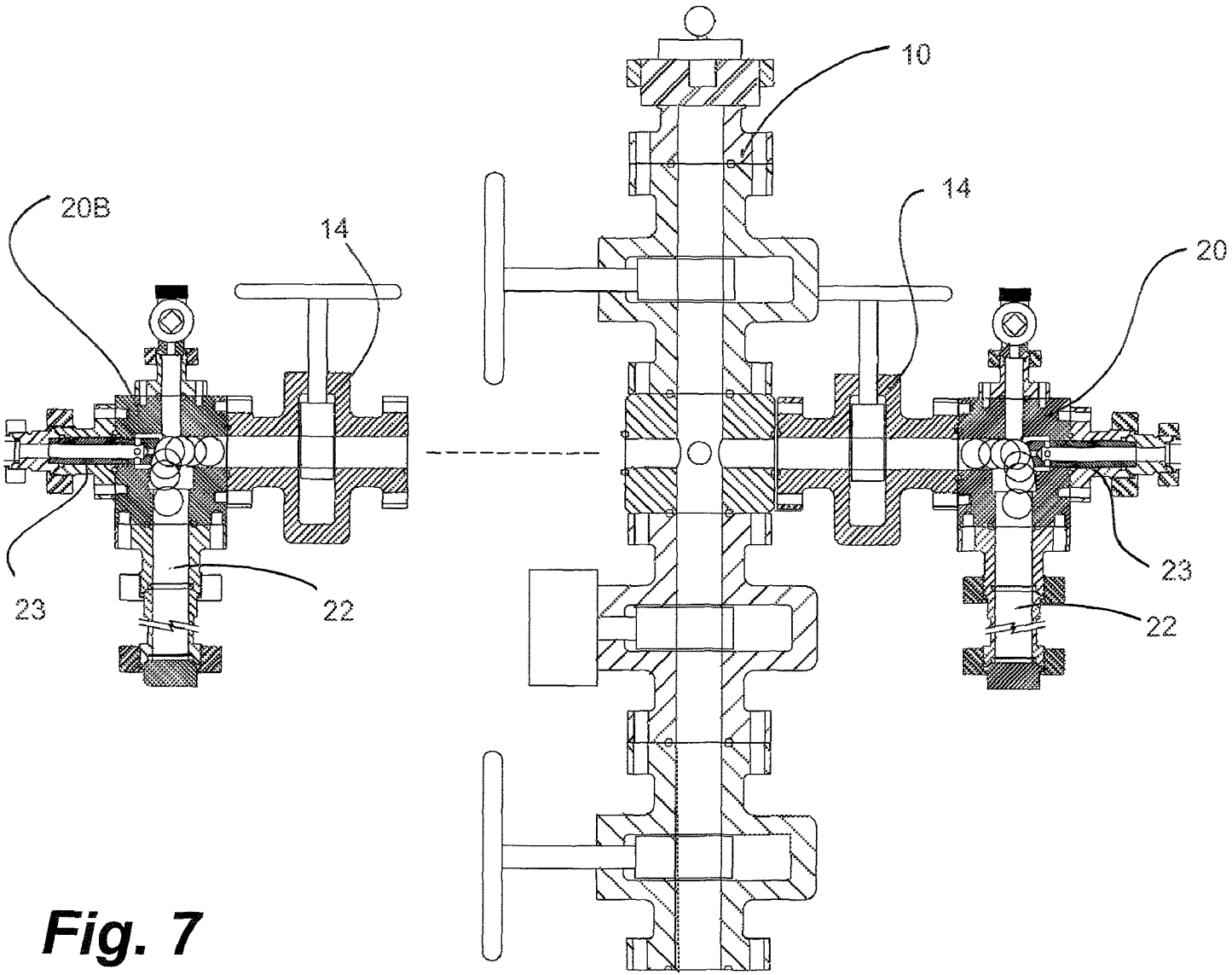
FIG. 7 is a cross-sectional view of a wellhead of conventional configuration fit with a first ball catcher and showing a second ball catcher for connection to the wellhead according to another embodiment of the invention.

With reference to FIG. 7, a second ball catcher 20B, or more depending upon the wellhead, can be fit to the wellhead 10 of FIG. 1, also with isolation valving 14,14 between the wellhead 10 and each of the ball catchers 20,20B. Accordingly, the first ball catcher 20 can be serviced, for replacement of the diverter 23 or inspection and cleaning of the chamber 22, while the second ball catcher 20B is in operation. In this way, wellhead flow is not interrupted. In some wellbores, even a temporary interruption can result in an unfavorable loss of suspended materials which are being elutriated from the wellbore with the fluid flow. Accordingly, redundant ball catchers 20,20B are affixed to two or more flow paths 13 from the wellhead so that fluid flow F from the wellbore can be substantially continuous to the second ball catcher 20B while the first ball catcher 20 is taken out of service.

Undesirable sand plugs or debris plugs can occur from the fallout and or the formation may lose its upward energy and die which requires expensive coil tubing to clean the well pipe. Also flowback disruption during coil clean out, or for example bridge plug mill out, needs to be avoided because the fallout can create a sand plug and jam around the coil tubing causing further and significant expense. The second ball catcher 20B can be opened for operation, both being used temporarily, before closing in the first catcher for servicing.

In another embodiment shown in FIG. 6, an isolation valve 62 can be provided to optionally temporarily block the ball recovery chamber 22 from the catcher body 21 for servicing. Further, a purge port 63 can be provided to introduce nitrogen to purge the ball recovery reservoir of noxious gases such as hydrogen sulphide.

The embodiments of the invention for which an exclusive property or privilege is claimed are defined as follows:

1. Apparatus for retrieving at least balls carried within a fluid flow from a wellhead port comprising:

a catcher body adapted to be fluidly connected to the wellhead port and having a flow outlet; and a diverter fit to the catcher body and having a wellhead end positioned to intercept the fluid flow from the wellhead port and to divert at least the balls carried therein into a ball recovery chamber, the diverter having a bore in fluid communication with the flow outlet and the wellhead end having flow passages formed therethrough to the bore for receiving the fluid flow free of at least the balls and discharging the fluid flow from the catcher body, wherein an annular chamber is formed between the catcher body and the wellhead end of the diverter and some of the flow passages being radial passages extending between the annular chamber and the bore, for directing at least some of the fluid flow.

2. The apparatus of claim 1 wherein the diverter is removeably fit to the catcher body.

3. The apparatus of claim 1 wherein the diverter is removeably fit through the flow outlet.

4. The apparatus of claim 1 wherein some of the flow passages extend substantially in-line with the wellhead port.

5. The apparatus of claim 1 wherein some of the flow passages extend substantially in-line with the wellhead port.

6. The apparatus of claim 1 wherein the wellhead end has a diverter face that is angled away from the fluid flow for directing at least the balls into the ball recovery chamber.

7. The apparatus of claim 6 wherein the diverter face has a concave face having an axis oriented generally towards the ball recovery chamber.

8. The apparatus of claim 1 wherein the plurality of radial fluid passages in the wellhead end of the diverter are arranged in pairs of opposing passages for directing fluid therefrom to impinge each other within the bore.

9. The apparatus of claim 1 wherein the diverter is secured in the flow outlet with a quick connection.

10. The apparatus of claim 1 wherein the diverter is two pieces comprising the wellhead end removeably coupled to a tail end.

11. The apparatus of claim 1 wherein the wellhead end is formed of wear resistant material.

12. The apparatus of claim 1 wherein the wellhead end flow ports are wear resistant.

13. The apparatus of claim 1 further comprising a pup joint releaseably coupled to the ball recovery chamber.

14. The apparatus of claim 1 further comprising redundant catcher bodies affixed to each of two or more flow paths from the wellhead so that fluid flow from the wellbore can be substantially continuous to a first catcher body while a second catcher body is taken out of service.

15. The apparatus of claim 1 wherein the fluid flow further includes debris carried therein, and wherein the diverter intercepts the fluid flow and further diverts at least the balls and debris carried therein to the ball recovery chamber.

16. Apparatus for retrieving at least balls carried with wellbore fluid flowing from a wellhead comprising:

a catcher body positioned along a flow path of fluid from the wellhead, the catcher body having a flow path contiguous with the fluid flow from the wellhead, a flow outlet and a ball recovery chamber which intersects the flow path, at least the balls having a first velocity vector along the flow path;

a diverter fit to the catcher body and having a wellhead end extending into the flow path, a bore being open at a tail end and in fluid communication with the flow outlet, and having a diverter face at the wellhead end, the wellhead end being positioned inline with the first velocity vector for intercepting and substantially arresting balls and diverting at least the balls into the ball recovery chamber; and a plurality of flow passages extending through the wellhead end of the diverter the bore for conducting fluid flow, free of at least the balls from about wellhead end to the bore for discharge through the tail end, wherein an annular chamber is formed in the flow outlet about the wellhead end of the diverter for receiving the fluid flow, at least some of the fluid continuing to flow substantially along the flow path and about the diverter face.

17. The apparatus of claim 16 wherein the first velocity vector is substantially horizontal and wherein the ball recovery chamber is positioned below the flow path and below the diverter face.

18. The apparatus of claim 16 wherein the diverter face is angled away from the fluid flow for directing at least the balls into the ball recovery chamber.

19. The apparatus of claim 18 wherein the diverter face has a concave face having an axis oriented generally downwards towards the ball recovery chamber.

20. The apparatus of claim 16 wherein the plurality of fluid passages in the wellhead end of the diverter are arranged in pairs of opposing passages for directing fluid from the annular chamber to impinge each other within the bore.

21. The apparatus of claim 16 wherein the diverter is secured in the flow outlet with a quick connection.

22. The apparatus of claim 16 wherein the diverter is two pieces comprising the wellhead end removeably coupled to the tail end.

23. The apparatus of claim 16 wherein the wellhead end is formed of wear resistant material.

24. The apparatus of claim 16 further comprising a pup joint releaseably coupled to the ball recovery chamber.

25. The apparatus of claim 16 wherein the wellbore fluid further includes oversize debris carried therein and wherein the diverter diverts at least the balls and oversize debris carried therein into the ball recovery chamber, and wherein the fluid flow conducted through the plurality of flow passages is free of at least the balls and oversize debris.

* * * * *